United States Patent [19]

Stroud

[11] 4,397,215

[45] Aug. 9, 1983

[54] SYSTEM FOR CONTROLLING THE TEMPERATURE OF THE UPPER END OF A MISSILE

[75] Inventor: Vernon Stroud, Palo Alto, Calif.

[73] Assignee: Westinghouse Electric Corp., Pittsburgh, Pa.

[21] Appl. No.: 232,288

[22] Filed: Feb. 6, 1981

[51] Int. Cl.[3] ..... F41F 3/04

[52] U.S. Cl. ..... 89/1.816; 89/1.810; 165/41

[58] Field of Search ..... 89/1.809, 1.810, 1.816, 89/1.817, 1.8, 1.812; 102/374; 165/41

[56] References Cited

FOREIGN PATENT DOCUMENTS 1263011 4/1961 France ..... 89/1.8

*Primary Examiner*—Albert W. Davis, Jr.

*Attorney, Agent, or Firm*—F. J. Baehr, Jr.

[57] ABSTRACT

A diaphragm is disposed in the upper end of the launch tube to ensure circulation of air to control the temperature of the nose of a missile disposed in the launch tube.

8 Claims, 3 Drawing Figures

SYSTEM FOR CONTROLLING THE TEMPERATURE OF THE UPPER END OF A MISSILE

The U.S. Government has rights in this invention pursuant to Contract No. N00030-74-C-0132 between Westinghouse Electric Corporation and the Department of Defense.

BACKGROUND OF THE INVENTION

This invention relates to a cooling system for the upper end of a missile and more particularly to a system for controlling the temperature of the upper end of a missile disposed in a submarine.

Missile launches vertically installed in submarines store missiles in a ready state for extended periods. As part of the storage requirement, the launcher must maintain the missile temperature within certain predetermined limits. This temperature requirement is particularly difficult to maintain in the upper portion of the launcher which commonly protrudes above the main hull of the submarine. The upper portion of the launcher is also subjected to greater heat flux than the portion within the hull. Presently, temperature is maintained by water-cooled or heated panels located within the walls of the launcher. These panels control the temperature utilizing natural convection and thermal radiation. Force convection is not practical since the temperature differential and clearances around the missile are both very small.

SUMMARY OF THE INVENTION

A system for controlling the temperature of the upper end of a missile disposed in a launch tube having its upper end closed by a hatch, when made in accordance with this invention, comprises a port in the launch tube disposed below the hatch a blower for supplying and removing fluid from the launch tube disposed in fluid communication with the port, a heat exchanger disposed in fluid communication with the blower and a diaphragm disposed below the hatch. The diaphragm has a peripheral seal at the juncture of the diaphragm and the launch tube and cooperates with the blower so that fluid is passed over the upper end of the missile to control its temperature as fluid is alternately supplied and removed from the launch tube by the blower.

BRIEF DESCRIPTION OF THE DRAWINGS

The objects and advantages of this invention will become more apparent by reading the following detailed description in conjunction with the accompanying drawings, in which.

DESCRIPTION OF THE PREFERRED EMBODIMENTS

Figure 1:
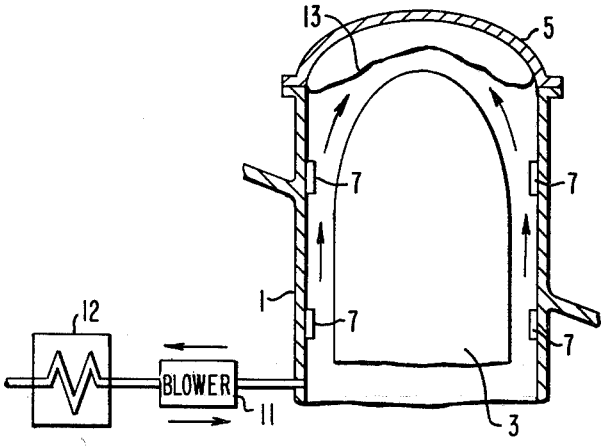
FIG. 1 is a partial sectional view of a launch tube with a temperature control system disposed therein.
Figure 2:
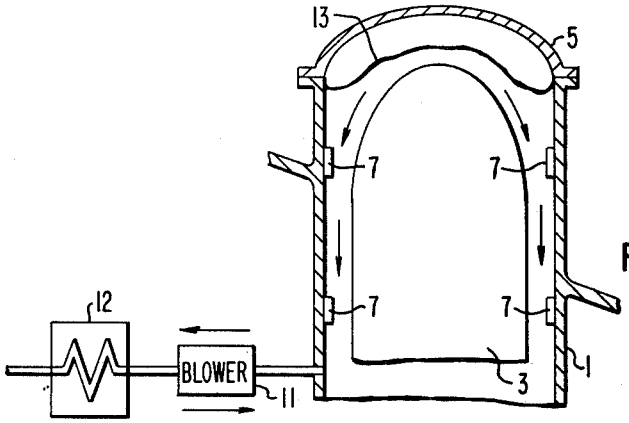
FIGS. 2 and 3 are partial sectional views showing various stages in the operation of the temperature control system.
Figure 3:
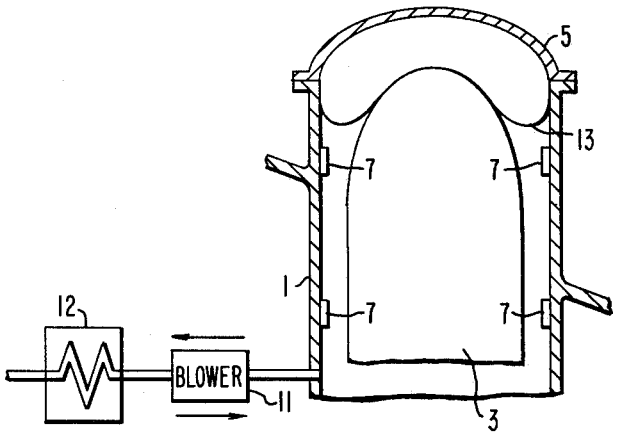

Referring now to the drawings in detail, there is shown a portion of a vertically oriented launch tube 1 with a missile 3 disposed therein. A removable hatch 5 encloses the upper end of the launch tube 1. Disposed within the launch tube 1 below the hatch 5 are heat exchangers 7, which are supplied with cold or hot water depending on the temperature within the launch tube. A port 9 is also disposed in the launch tube wall below the hatch 5. In fluid communication with port 9 is a blower 11 or other means for supplying and removing air or other fluid from the launch tube 1. A separate heat exchanger 12 may also be disposed in fluid communication with the blower 11 to change the temperature of the influent air. A diaphragm 13 is disposed in the launch tube below the hatch 5. The diaphragm 13 has a large amount of sag and its periphery is sealed at its juncture with the launch tube 1.

To control the temperature of the upper end of the missile 3, air is alternately supplied and removed from the launch tube via the blower 11 causing the pressure in the launch tube 1 to increase or decrease. Air or some other compressible fluid is disposed between the diaphragm 13 and the hatch 5 causing the sagging diaphragm to move toward the hatch or drop down on the missile as the pressure within the launch tube 1 changes in order to ensure movement of air over the heat exchangers 7 and upper end of the missile 3 to facilitate controlling the temperature of the upper end of the missile.

What is claimed is:

1. A system for controlling the temperature of the upper end of a missile disposed in a launch tube having its upper end closed by a hatch, the system comprising:

a port in the launch tube disposed below the hatch;

means for supplying and removing fluid from said launch tube disposed in fluid communication with the port;

a heat exchanger disposed in fluid communication with the fluid supply and removing means;

a diaphragm disposed below the hatch;

a peripheral seal at the junction of the diaphragm and the launch tube whereby fluid is passed over the upper end of the missile to control its temperature as fluid is alternately supplied and removed from the launch tube.

2. A system as set forth in claim 1 wherein the heat exchanger can supply or remove heat.

3. A system as set forth in claim 1 wherein the diaphragm is larger than the cross-sectional area of the launch tube.

4. A system as set forth in claim 1 wherein the diaphragm has a substantial amount of sag.

5. A system as set forth in claim 1 wherein the diaphragm contacts the missile when fluid is removed from the launch tube and is spaced from the missile when fluid is supplied to the launch tube.

6. A system as set forth in claim 1 wherein the heat exchanger is disposed within the launch tube below the hatch.

7. The system as set forth in claim 1 wherein the heat exchanger is disposed outside of the launch tube.

8. The system as set forth in claim 1 wherein a heat exchanger is disposed within the launch tube and an additional heat exchanger is disposed externally of the launch tube.

* * * * *